US009861842B2

(12) United States Patent
Wagner

(10) Patent No.: US 9,861,842 B2
(45) Date of Patent: Jan. 9, 2018

(54) SYSTEM AND METHOD FOR REDUCING OXYGEN IN A TARGET ROOM

(71) Applicant: AMRONA AG, Zug (CH)

(72) Inventor: Ernst-Werner Wagner, Aller (DE)

(73) Assignee: AMRONA AG, Zug (CH)

( * ) Notice: Subject to any disclaimer, the term of this patent is extended or adjusted under 35 U.S.C. 154(b) by 0 days.

(21) Appl. No.: 14/918,123

(22) Filed: Oct. 20, 2015

(65) Prior Publication Data

US 2016/0114200 A1 Apr. 28, 2016

(30) Foreign Application Priority Data

Oct. 24, 2014 (EP) ..... 14190250

(51) Int. Cl.
*A62C 2/04* (2006.01)
*A62C 99/00* (2010.01)

(52) U.S. Cl.
CPC ..... *A62C 2/04* (2013.01); *A62C 99/0018* (2013.01)

(58) Field of Classification Search
CPC .... A62C 2/04; A62C 99/0009; A62C 99/0018
See application file for complete search history.

(56) References Cited

U.S. PATENT DOCUMENTS

2003/0226669 A1* 12/2003 Wagner ..... A62C 99/0018 169/45
2008/0196907 A1* 8/2008 Wagner ..... A62C 99/00 169/45
2009/0038811 A1 2/2009 Wagner

FOREIGN PATENT DOCUMENTS

EP 2233175 A1 9/2010

* cited by examiner

*Primary Examiner* — Christopher Kim
(74) *Attorney, Agent, or Firm* — Cesari and McKenna, LLP; Omar M. Wadhwa

(57) ABSTRACT

A system for reducing oxygen in a target room, particularly for the purpose of controlling or preventing fire, wherein the system comprises an enclosed buffer space which is fluidly connectable or connected to the target room for the as-needed introduction of at least a portion of the room air of the buffer space into the target room. The system moreover comprises an oxygen-reducing mechanism allocated to the buffer space for setting and maintaining a reduced oxygen content in the spatial atmosphere of the buffer space compared to the normal earth atmosphere such that the oxygen content in the spatial atmosphere of the buffer space is lower than the oxygen content in the spatial atmosphere of the target room. The system moreover comprises a mechanism for introducing room air from the buffer space into the target room as needed.

10 Claims, 5 Drawing Sheets

SYSTEM AND METHOD FOR REDUCING OXYGEN IN A TARGET ROOM

CROSS-REFERENCE TO RELATED APPLICATIONS

The present application claims the benefit of the following commonly assigned European Patent Application Serial No. EP 14 190 250.2, which was filed on Oct. 24, 2014 and is hereby incorporated by reference.

BACKGROUND OF THE INVENTION

Field of the Invention

The invention relates to a system for reducing oxygen within a target room, particularly for the purpose of controlling or preventing fire.

Background Information

The invention relates in particular to a system for reducing oxygen, wherein the system comprises an enclosed buffer space fluidly connectable or connected to the target room for introducing at least a portion of the room air of the buffer space into the target room as needed. The system further comprises an oxygen-reducing mechanism allocated to the buffer space designed to set and maintain a reduced oxygen content in the spatial atmosphere of the buffer space compared to the normal ambient air so that the oxygen content in the spatial atmosphere of the buffer space is lower than the oxygen content in the spatial atmosphere of the target room.

The invention further relates to a method for reducing the oxygen within a target room, particularly for the purpose of controlling or preventing fire. The method hereby provides for using an oxygen-reducing mechanism allocated to the buffer space to set and maintain an oxygen content in the spatial atmosphere of an enclosed buffer space fluidly connectable or connected to the target room which is reduced compared to the normal ambient air. The oxygen content in the spatial atmosphere of the buffer space is hereby lower than the oxygen content in the spatial atmosphere of the target room. Oxygen-reducing systems of the above-cited type are in principle known from the prior art.

For example, assigning an oxygen-reducing mechanism to a room and said mechanism reducing the oxygen content in the spatial atmosphere of the room is already known. Using such an oxygen-reducing mechanism to prevent fire by permanently reducing the oxygen content in a room or in a plurality of rooms, for example to a value between 13% and 18% by volume, is also already known.

When the rooms are of distinctly different sizes, there is the risk that the oxygen-reducing mechanism dimensioned for a larger room will not be suited to setting and maintaining a defined oxygen content in a smaller room. Fire protection for the smaller room must either be realized with a stationary fire extinguishing system or with a further oxygen-reducing mechanism.

In practice, however, providing a stationary fire extinguishing system or another oxygen-reducing mechanism has shown to be inefficient and expensive, particularly in the case of smaller rooms such as for example utility rooms associated with large stockrooms.

SUMMARY OF THE INVENTION

The present invention is based on the task of further developing an oxygen-reducing system of the type cited at the outset to the effect of being able to efficiently, in particular cost-efficiently, protect a smaller target room adjoining a large room from fire.

An accordingly optimized method for reducing oxygen in a target room for the purpose of controlling or preventing fire is moreover to be specified.

With respect to the mechanism, the task underlying the invention is inventively solved by the subject matter of independent claim 1. With respect to the method, the task underlying the invention is solved by the subject matter of additional independent claim 8. Advantageous further developments of the inventive system are set forth in the dependent claims.

Hence, the invention in particular specifies a system for reducing oxygen in a target room, particularly for the purpose of controlling or preventing fire, wherein the system comprises an enclosed buffer space which is fluidly connectable or connected to the target room for the as-needed introduction of at least a portion of air from the buffer space into the target room. The system further comprises an oxygen-reducing mechanism allocated to the buffer space for setting and maintaining a reduced oxygen content in the spatial atmosphere of the buffer space compared to the normal ambient air so that the oxygen content in the spatial atmosphere of the buffer space is lower than the oxygen content in the spatial atmosphere of the target room. The system further comprises a mechanism for introducing room air from the buffer space into the target room as needed. The ratio between the spatial volume of the buffer space and the target room is selected on the one hand, and the oxygen content in the spatial atmosphere of the buffer space is reduced compared to the oxygen content of the normal ambient air prior to the introduction of room air from the buffer space into the target room on the other hand, such that the oxygen content of the target room's spatial atmosphere drops below a predefined value and the oxygen content of the buffer space's spatial atmosphere rises by no more than 0.15% by volume subsequent the room air from the buffer space having been introduced into the target room.

The solution according to the invention achieves the following advantages. It is frequently the case in practice for a large room such as a stockroom, for example, to be rendered inert for the purpose of controlling or preventing fire. Inertization means a reduced oxygen content in comparison to the oxygen content of normal ambient air. Such a reduction results in extinguishing or preventing fire since fire always requires oxygen. Such a stockroom thus generally has a dedicated oxygen-reducing mechanism. The oxygen-reducing mechanism ensures that an oxygen content below the oxygen content of normal ambient air is set in the stockroom when needed or on an on-going basis.

A stockroom as described is often associated with one or more smaller spaces. These spaces can be utility rooms, equipment rooms for oxygen-reducing mechanisms, IT or server rooms, order-picking areas, storage rooms or other such similar spaces. These spaces are normally often frequented by employees, etc. These spaces also contain fire loads (goods, equipment, etc.) and need to be protected against fire. As a general rule, a further fire prevention system is provided for this purpose. Such an additional system naturally entails further expenditure and additional costs.

In accordance with the present invention, no additional system is needed and instead the room air of the buffer space, its oxygen content being lower than the oxygen content of the normal ambient air, can be used when needed to lower the oxygen content in the target room. Thus, with the invention, there is no need to provide the smaller room (target room) with an additional dedicated fire extinguishing system or oxygen-reducing mechanism. Only one mechanism for the as-needed introduction of room air from the buffer space into the target room is necessary. Compared to existing systems, this solution thus represents substantial simplification and cost reduction.

In accordance with the invention, the volume of the buffer space and the volume of the target room are selected such that the buffer space is considerably larger than the target room. Doing so takes advantage of the knowledge that when room air from the buffer space is introduced into the target room along with optionally simultaneously supplying fresh air into the buffer space for the purpose of equalizing pressure, and the oxygen content in the buffer space thereby correspondingly rising, the oxygen content in the buffer space only rises to the degree of continuing to ensure the control or prevention of fire in the buffer space.

As an example, the volume of such a buffer space is 200,000 to 600,000 m3 and the volume of a target room 1000 to 2000 m3. The buffer space is thus 100 to 600 times larger than the target room. The oxygen content in the buffer space is lower than the oxygen content of the normal ambient air, e.g. 14% by volume. However, normal atmosphere prevails in the target room; i.e. 20.9% O2 by volume. Such a ratio between the spatial volume and the oxygen concentration allows the oxygen concentration in the buffer space to rise by no more than 0.15 vol % when room air from the buffer space continues being introduced into the target room until the oxygen content in the target room drops below a predefined value, e.g. to 15.5% by volume. This thereby takes advantage of the knowledge that given a large buffer space/target room volumetric ratio, a single oxygen-reducing mechanism is sufficient to ensure both continuous inerting of the buffer space as well as the as-needed inerting of the target room to control or prevent fire.

In accordance with one aspect of the invention, the mechanism comprises a fan or blower fluidly connected or connectable to the buffer space on the one side and the target room on the other for the introducing of room air from the buffer space into the target room when needed.

Such a fan or blower respectively is used to introduce air from the buffer space into the target room when needed. It is of course substantially simpler to realize such a fan or blower than it is to provide the target room with a further extinguishing mechanism or oxygen-reducing mechanism. A plurality of fans or blowers can also be used for this purpose.

In accordance with a further aspect of the invention, the mechanism comprises a device for introducing room air from the buffer space into the target room when needed for the as-needed opening of a vent fluidly connecting the buffer space to the target room, particularly a door, bulkhead, roll-up door or an air lock.

Such a vent can realize or respectively enable an inflow of air from the buffer space into the target room when needed.

The pressure difference between the buffer space and the target room due to room air being introduced from the buffer space into the target room can be equalized by leakages in the spatial shell when the spatial shell is not too impervious.

According to a further aspect of the invention, a pressure-compensating device is provided to compensate a pressure differential between the buffer space and the target room resulting from the introduction of room air from the buffer space into the target room.

Such a pressure-compensating device can be fluidly connected or connectable both to the buffer space as well as to the target room. The pressure-compensating device can additionally or instead be fluidly connected or connectable to the target room and to the external atmosphere. Moreover or additionally, the pressure-compensating device can be fluidly connected or connectable to buffer space and to the external atmosphere.

Such a pressure-compensating device ensures that no negative and/or positive pressure develops in the buffer space and/or the target room. Pressure relief flaps can for example be used to this end. Other mechanisms for equalizing pressure are of course also conceivable.

According to a further aspect of the invention, the introduction of air from the buffer space into the target room can lower the oxygen content in the target room to a value corresponding to the critical oxygen concentration limit for extinguishing fire.

Thus, introducing room air from the buffer space into the target room can realize effective control and/or prevention of fire in the target room. Such an oxygen concentration limit can for example be an oxygen concentration of 12 to 18% by volume. It is however also conceivable for an even lower oxygen content to be reached in the target room. In the case of data processing centers, for example, the oxygen concentration limit is established at 15.0% O2 by volume. If a further safety margin is to be taken, an oxygen concentration down to 13.8% O2 by volume can be stipulated as the target concentration for data processing centers.

According to a further aspect of the invention, an oxygen-reducing mechanism is allocated to the target room for setting and maintaining a reduced oxygen content in the room air of the target room in comparison to the normal ambient air.

For example, if the oxygen-reducing mechanism allocated to the target room is of relatively small dimension, the oxygen content in the target room is reduced to 18 vol %. While this oxygen content does not correspond to the oxygen concentration limit, the risk of fire is nonetheless reduced and personnel are permitted to use the target room without being subject to major occupational liability or medical conditions.

This can thereby achieve a reduced oxygen content already prevailing in the target room, and thus less room air needing to be introduced from the buffer space into the target room in order to lower the oxygen content in the target room to the critical oxygen concentration limit for extinguishing fire. Doing so can thereby accelerate the control of fire in the target room or respectively facilitate preventing fire in the target room. Yet such an oxygen-reducing mechanism allocated to the target room can be of considerably smaller design than an oxygen-reducing mechanism required for full fire control since room air is supplied as needed from the buffer space. This aspect of the invention can thus also achieve increased efficiency as well as a reduction of costs.

With respect to the method for reducing oxygen in a target room, particularly for the purpose of fire control or prevention, the following method steps are provided. First, an oxygen content which is reduced in comparison to the normal ambient air is set and maintained in the spatial atmosphere of an enclosed buffer space fluidly connectable or connected to the target room by means of an oxygen-reducing mechanism associated with the buffer space, whereby the oxygen content in the spatial atmosphere of the buffer space is lower than the oxygen content in the spatial atmosphere of the target room. Room air from the buffer space is furthermore introduced into the target room in order to reduce the oxygen content in the spatial atmosphere of the target room. The ratio between the spatial volume of the buffer space and the target room is hereby selected on the one hand, and the oxygen content in the spatial atmosphere of the buffer space is reduced compared to the oxygen content of the normal ambient air prior to room air being introduced from the buffer space into the target room on the other hand, such that the oxygen content in the target room's spatial atmosphere drops below a predefined value and the oxygen content of the buffer space's spatial atmosphere rises by no more than 0.15% by volume subsequent the room air from the buffer space being introduced into the target room.

In accordance with one aspect of the invention, pressure equalization for compensating a pressure differential between the buffer space and the target room occurs during the introduction of the room air from the buffer space into the target room and/or subsequent the introduction of the room air from the buffer space into the target room.

Doing so can prevent positive or negative pressure from developing in the buffer space and/or target room which could damage the structure of said buffer space and/or target room.

In accordance with one aspect of the invention, the pressure equalization between the buffer space and the target room is realized by the buffer space being fluidly connected to the target room and by the buffer space and/or target room being fluidly connected to the external atmosphere.

On the other hand, it is also conceivable for the pressure equalization to be realized by the buffer space being additionally or instead fluidly connected to the target room.

According to a further aspect of the invention, the oxygen concentration in the spatial atmosphere of the target room is measured or otherwise determined continuously or at predefined times and/or upon predefined events, whereby room air is introduced from the buffer space into the target room as a function of the measured or otherwise determined oxygen content.

This procedure is then of particular advantage when a specific oxygen content is to be set and maintained in the spatial air of the target room. If a deviation from the desired oxygen content is detected in the air of the target room, air from the buffer space can be correspondingly introduced into the target room or the introduction of room air from the buffer space into the target room can be interrupted or slowed.

According to a further aspect of the invention, the target room is monitored for the presence of fire characteristics continuously or at predefined times and/or events, whereby room air from the buffer space is introduced into the target room when at least one fire characteristic is detected in the target room, wherein room air from the buffer space continues to be introduced into the target room until the oxygen content in the spatial atmosphere of the target room assumes a value which corresponds to the maximum critical oxygen concentration limit for extinguishing fire. This procedure can effectively detect and control a fire.

According to a further aspect of the invention, the oxygen concentration in the spatial atmosphere of the buffer space is measured or otherwise determined continuously or at predefined times and/or upon predefined events, whereby an oxygen-reduced gas or gas mixture is fed into the spatial atmosphere of the buffer space by the oxygen-reducing mechanism allocated to the buffer space as a function of the measured or otherwise determined oxygen content.

Doing so can thereby in particular achieve the oxygen content in the buffer space at no time exceeding a value which would result in fire extinguishing or prevention no longer being ensured in the buffer space. The oxygen-reducing mechanism is accordingly to be operated such that effective fire prevention and/or extinguishing is achieved in the buffer space at all times. Doing so thus inventively also automatically enables effective fire prevention and/or control in the target room.

The solution according to the invention thus provides a highly efficient system in which only one oxygen-reducing mechanism is needed.

The following will reference the accompanying drawings in describing the oxygen-reducing system according to the invention in greater detail based on example embodiments.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
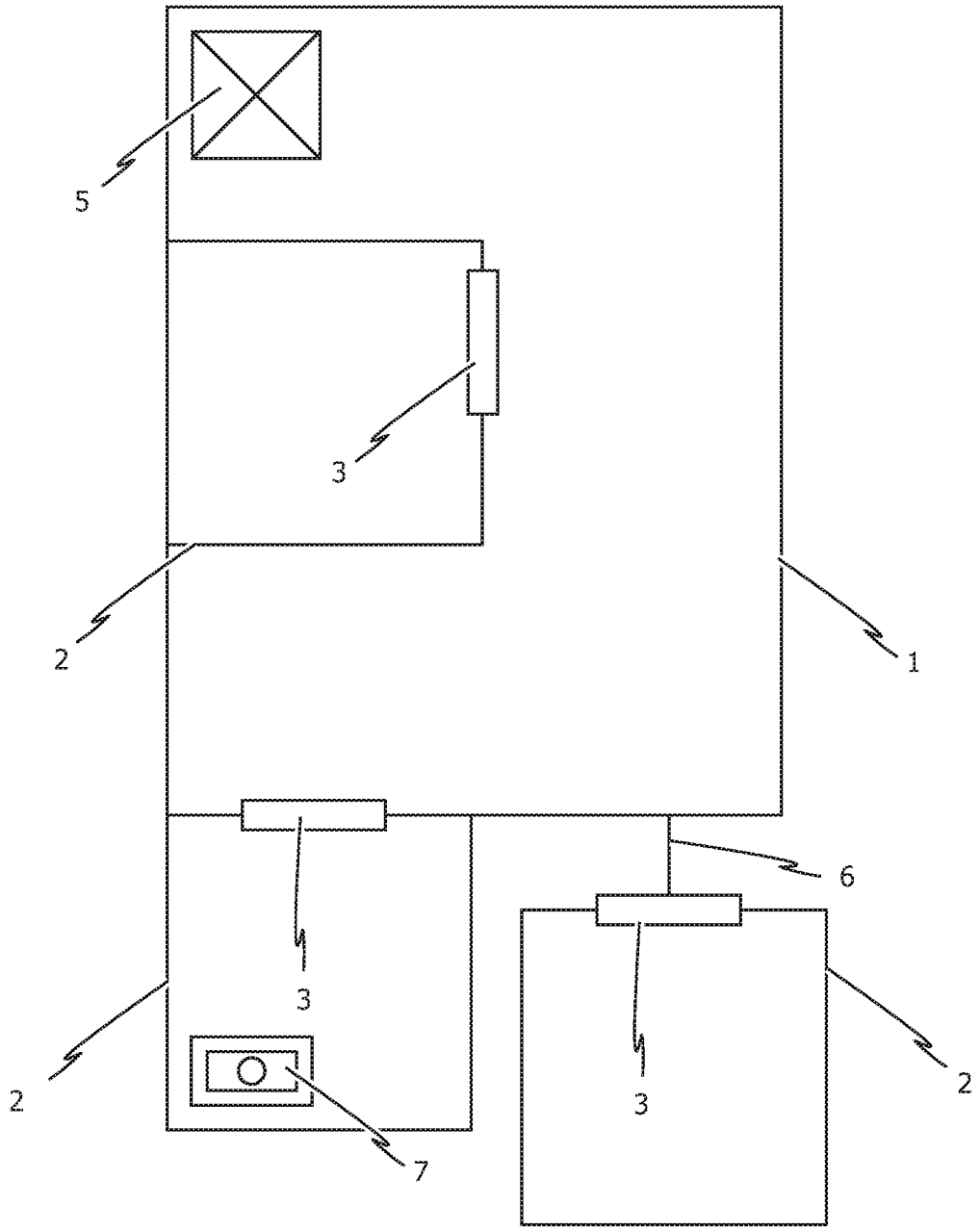
FIG. 1: a schematic depiction of an example embodiment of the inventive system for reducing oxygen in a target room.
Figure 2:
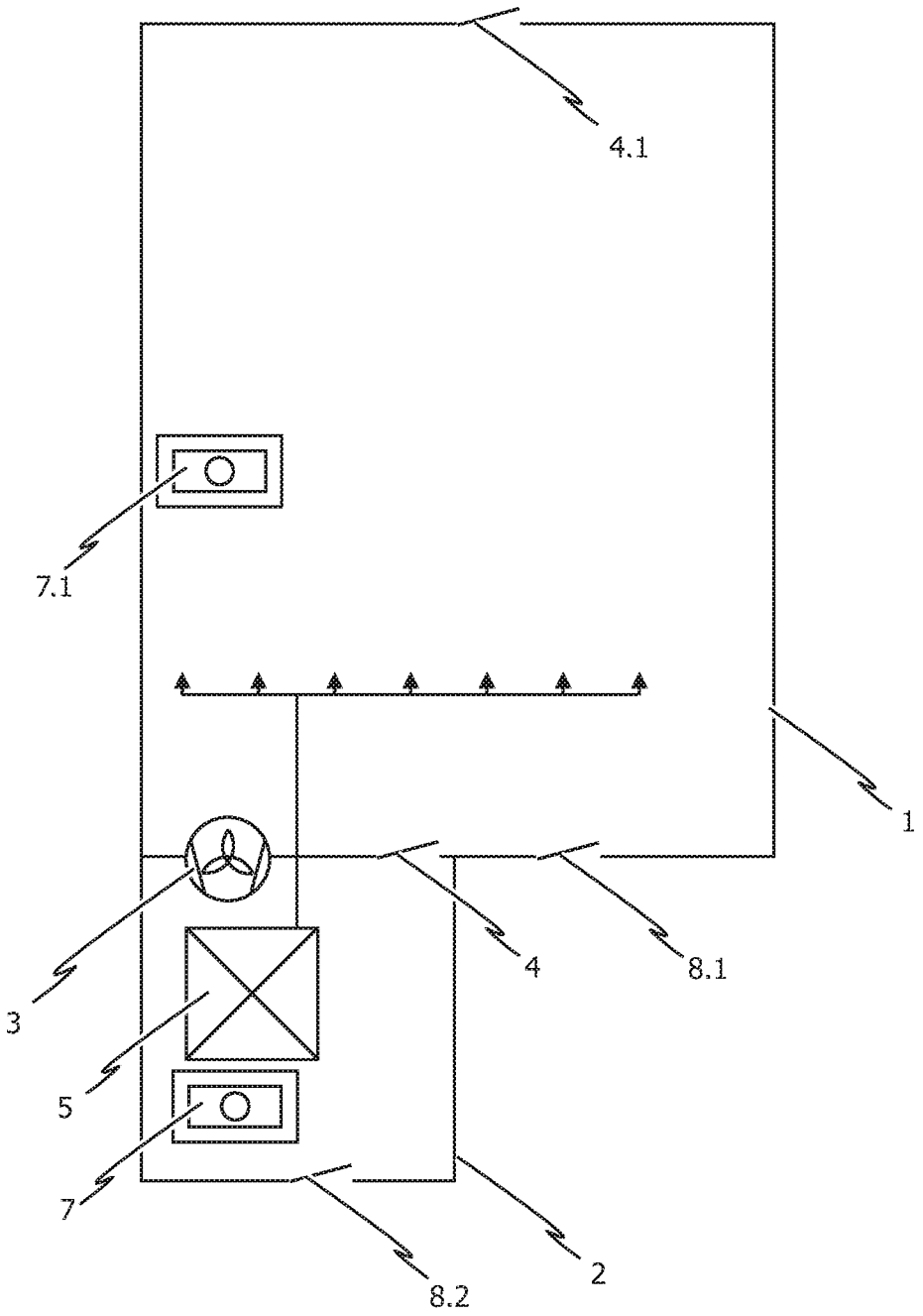
FIG. 2: a schematic depiction of an example embodiment of the inventive system for reducing oxygen in a target room comprising a fan.
Figure 3:
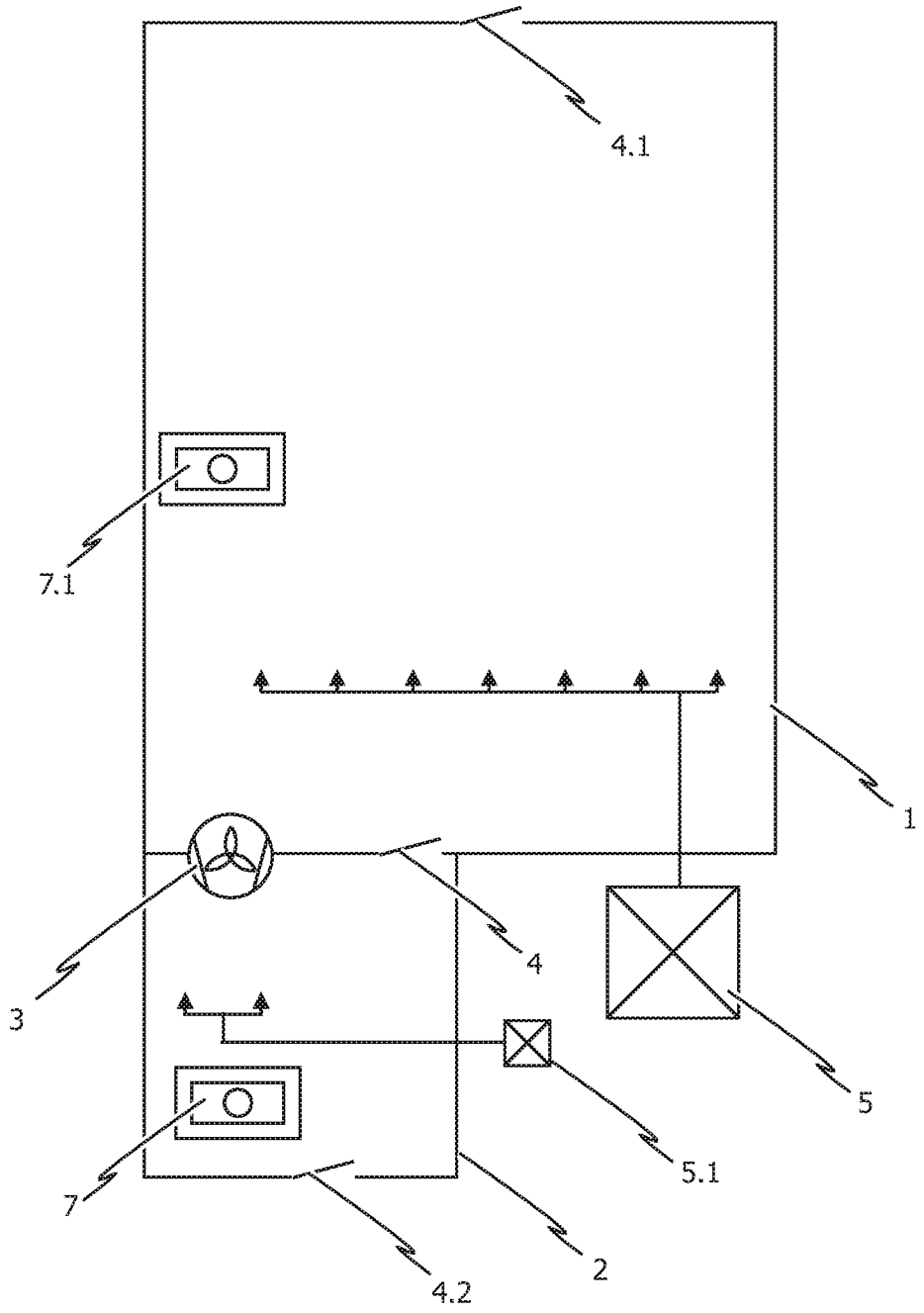
FIG. 3: a schematic depiction of an example embodiment of the inventive system for reducing oxygen in a target room comprising a further oxygen-reducing mechanism.
Figure 4:
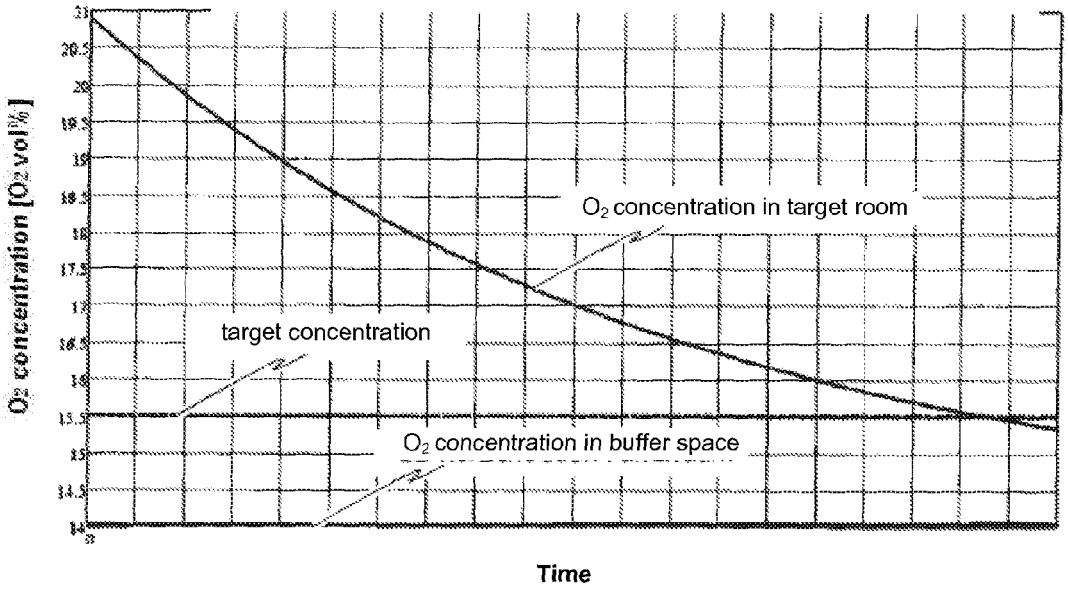
FIG. 4: a graphic depiction of the oxygen concentration gradient in a target room and in a buffer space during the introduction of room air from the buffer space into the target room at normal atmosphere.
Figure 5:
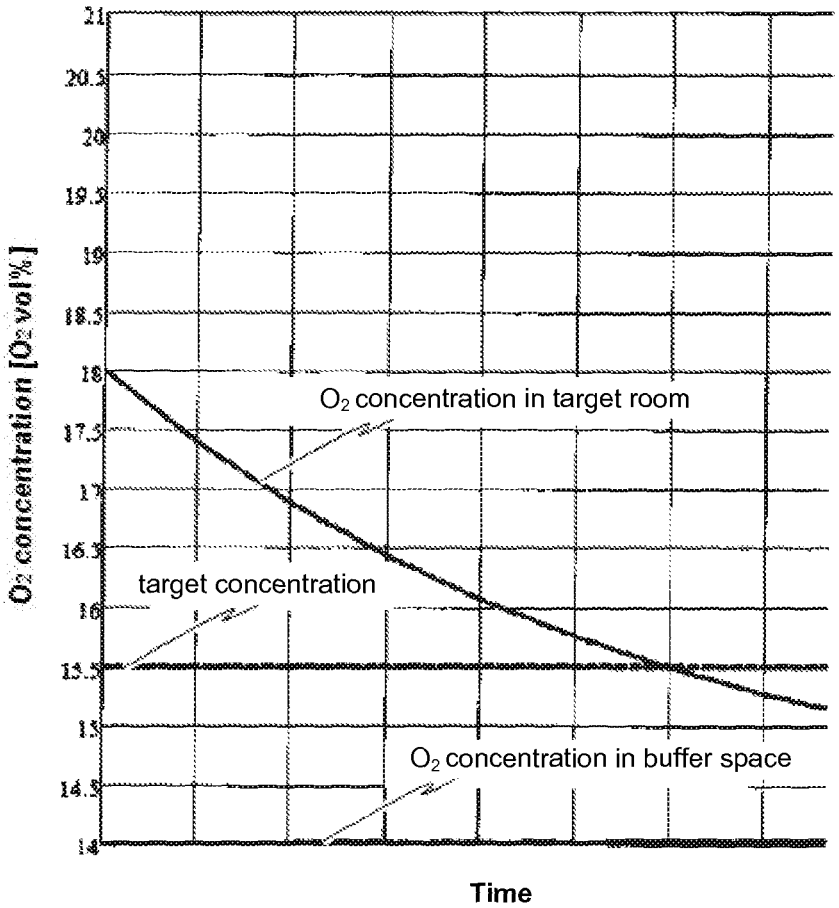
FIG. 5: a graphic depiction of the oxygen concentration gradient in a target room and in a buffer space during the introduction of room air from the buffer space into the target room at an already reduced oxygen content.

The following will reference the FIG. 1 to 3 depictions in describing example embodiments of the inventive system for reducing oxygen in a target room.

FIG. 1 shows a buffer space 1 having a volume of for example from 100,000 to 600,000 m3. This buffer space 1 is assigned to a target room 2. The target room 2 can for example be a utility room or an order-picking area or the like. Compared to the buffer space 1, the target room 2 is of substantially smaller spatial volume. Said spatial volume can for example be a spatial volume of from 1000 to 2000 m3.

The target room 2 can moreover be arranged directly adjoining the buffer space 1. The target room 2 can also be located within the buffer space 1 or arranged at a distance from the buffer space 1. In each case, however, a mechanism 3 is provided according to the invention which is designed to connect the buffer space 1 to the target room 2 such that room air from the buffer space 1 can be introduced into the target room 2.

To this end, a connection 6 can for example connect the mechanism 3 to the buffer space 1 on one side and to the target room 2 on the other. The connection 6 can for example be a ventilation shaft or the like.

The buffer space 1 is moreover allocated an oxygen-reducing mechanism 5. The oxygen-reducing mechanism 5 can be arranged within the buffer space 1. The oxygen-reducing mechanism 5 can moreover be arranged directly adjoining or at a distance from the buffer space 1. In each case, the oxygen-reducing mechanism 5 is designed to lower the oxygen content in the buffer space 1 in comparison to the oxygen content of normal ambient air. This reduction realizes the achieving of effective fire prevention and/or control in the buffer space. The oxygen content to be set in the buffer space 1 is heavily dependent on the goods, commodities or objects located within said buffer space 1. As a general rule, an oxygen concentration of between 12 to 18% by volume is set in the buffer space 1. However, setting a lower oxygen concentration in the buffer space 1 is also conceivable.

As shown in FIG. 3, the oxygen content of the buffer space 1 room air can be measured by e.g. a sensor 7.1. When the sensor 7.1 registers that that oxygen content of the buffer space 1 room air deviates from a target value, the oxygen-reducing mechanism 5 can be actuated so as to adjust the oxygen content accordingly.

As also in the buffer space 1 itself, fire can be effectively prevented or controlled in the target room 2 associated with the buffer space 1. To this end, the invention provides for the mechanism 3 to be able to introduce room air from the buffer space 1 into the target room 2. Said introduction can occur on an as-needed basis when a fire needs to be controlled or prevented in the target room 2.

To this end, a sensor 7 able to detect a fire characteristic in the target room 2 can for example be provided in said target room 2. When the sensor 7 detects a fire characteristic in the target room 2, the mechanism 3 is actuated so as to introduce room air from the buffer space 1 into the target room 2.

It is hereby inventively provided for the spatial volume and the oxygen concentration of the buffer space 1 to have a certain relationship to the spatial volume and the oxygen concentration of the target room 2. The spatial volume and oxygen concentration are selected such that while the room air from the buffer space 1 is being introduced into the target room 2 until the point at which the oxygen content in the target room 2 drops below a predefined value, the oxygen content in the buffer space 1 rises by a maximum of 0.15% by volume.

It is hereby to be kept in mind that the oxygen content in the buffer space 1 slightly increases when room air is introduced from the buffer space 1 into the target room 2 since fresh air is supplied to the buffer space 1 for example through structural shell leakages or pressure-compensating devices while room air is being introduced from the buffer space 1 into the target room 2. This occurs so that the pressure in buffer space 1 will be equalized.

To this end, one or more pressure-compensating devices 4, 4.1, 4.2 can be provided as shown in FIG. 2. These pressure-compensating devices are for example pressure-equalizing valves. However, other mechanisms able to ensure an equalization of pressure in the buffer space 1 and/or the target room 2 are of course also conceivable. As can be seen in FIG. 2, a pressure-compensating device 4.1 can be arranged within the buffer space 1 so as to enable an equalizing of pressure between the ambient air and the buffer space 1 room air. A pressure-compensating device 4 can additionally or instead be arranged between the space 1 and the target room 2 so as to enable an equalizing of pressure between the buffer space 1 room air and the target room 2 air. Additionally or instead thereto, a pressure-compensating device 4.2 can be provided between the normal environment and the target room 2 so as to enable an equalizing of pressure between the normal ambient air and the room air in target room 2.

If room air is now introduced from the buffer space 1 into the target room 2 in order to prevent or extinguish a fire in the target room 2, fresh air can for example be supplied to the buffer space 1 via the pressure-compensating device 4.1. Under normal conditions, said fresh air has an oxygen concentration of 21% by volume. Because the oxygen content in the room air of the buffer space 1 was first reduced by the oxygen-reducing mechanism 5, the oxygen content rises due to the fresh air introduced into the buffer space 1. To be kept in mind when room air is introduced into the target room 2 from the buffer space 1, is that such a volume of room air will be introduced from the buffer space 1 into the target room 2 that an oxygen concentration will be reached in the target room 2 which corresponds to the critical oxygen concentration limit for extinguishing fire. This can be an oxygen content of for example between 12 and 18% by volume, preferably between 13 and 15.5% by volume. Lower oxygen concentrations are also conceivable.

The spatial volume and the oxygen concentration of the buffer space 1 and the target room 2 are now selected such that the oxygen content in the buffer space 1 rises by no more than 0.15% by volume when room air is introduced into the target room 2 from the buffer space 1. It is hereby either provided for fresh air to be introduced into the buffer space 1 for the equalizing of pressure by means of the pressure-compensating device 4.1 or for a corresponding pressure-compensating device 4 to direct the room air of the target room 2 back into the buffer space 1.

A fan or a blower 3 is preferably used to introduce room air from the buffer space 1 into the target room 2. It is also conceivable for a door, a bulkhead, a roll-up door or an air lock to be provided between the buffer space 1 and the target room 2 for this purpose. Said door, bulkhead, roll-up door or air lock can be opened as needed so that room air will flow from the buffer space 1 into the target room 2. A fan or a blower hereby has the advantage of being able to introduce room air from the buffer space 1 into the target room 2 more quickly.

In the case where the pressure-compensating device 4.1 introduces fresh air into the buffer space 1 for the purpose of equalizing pressure while room air is being introduced from the buffer space 1 into the target room 2, it is preferably provided for the pressure to be equalized by means of a pressure-compensating device in target room 2. This is thus particularly advantageous since the pressure in target room 2 would otherwise rise sharply from the buffer space 1 room air being introduced into the target room 2, thereby potentially endangering the structural integrity of the target room 2.

In the procedural approach described above, the oxygen content in the target room prior to the room air from the buffer space 1 being introduced into said target room 2 preferably amounts to 21% by volume. It is however also conceivable for the oxygen content in the target room 2 to be permanently lowered and additional room air from the buffer space 1 to only be introduced into the target room 2 when needed, particularly for urgent firefighting purposes. This is then particularly advantageous when the oxygen content of the air in the buffer space 1 is considerably lower than the permanently reduced oxygen content in the target room 2. For example, the oxygen concentration in the buffer space 1 can amount to 14% by volume and that of the target room 18% by volume. To this end, a further oxygen-reducing mechanism 5.1 can be allocated to target room 2. To control fire, the oxygen content in the target room 2 can then be further lowered, for example to 15.5% by volume, by introducing room air from the buffer space 1 into said target room 2. The oxygen-reducing mechanism 5 can however also be used to lower the oxygen content in the target room 2. Furthermore, the sensor 7 can be used to introduce room air from the buffer space 1 into the target room 2 so as to lower the oxygen content in the target room 2. In so doing, the oxygen content in the target room 2 is not reduced all the way to the oxygen content of the buffer space 1 but rather only to for example 18% by volume. In the event of a fire, further room air can then be introduced into the target room 2 from the buffer space 1 so as to thereby further reduce the oxygen content in the target room 2.

The invention is not limited to the embodiments of the inventive system for reducing oxygen in a target room as depicted in the drawings but rather yields from a synopsis of all the features disclosed herein together.

LIST OF REFERENCE NUMERALS

1 buffer space
2 target room
3 mechanism (for the as-needed introducing of room air from the buffer space into the target room)/fan/blower/door/bulkhead/roll-up door/air lock
4, 4.1, 4.2 pressure-compensating device
5, 5.1 oxygen-reducing mechanism
6 connection
7 sensor
8.1, 8.2 access opening, feed opening

What is claimed is:

1. A system for reducing oxygen in a target room for the purpose of controlling or preventing fire, wherein the system comprises:

an enclosed buffer space fluidly connectable or connected to the target room for introducing at least a portion of a room air of the buffer space into the target room wherein a spatial volume of the buffer space is greater than a spatial volume of the target room;

an oxygen-reducing mechanism allocated to the buffer space for setting and maintaining a reduced oxygen content in a spatial atmosphere of the buffer space compared to normal earth atmosphere where the oxygen content in the spatial atmosphere of the buffer space is lower than an oxygen content in a spatial atmosphere of the target room; and a mechanism activated and introducing room air from the buffer space into the target room when a fire characteristic is detected in the target room, wherein a ratio between the spatial volume of the buffer space and the spatial volume of the target room is selected, and the oxygen content in the spatial atmosphere of the buffer space is reduced compared to the oxygen content of the normal earth atmosphere prior to introduction of the room air from the buffer space into the target room, a mechanism activated to introduce room air from the buffer space into the target room until the oxygen concentration in the spatial atmosphere of the target room drops below a predefined value to prevent or control a fire in the target room, wherein the predefined value is equal to or less than 18% by volume;

the mechanism deactivated when the oxygen concentration in the spatial atmosphere of the target room drops below the predefined value, wherein as the room air is introduced from the buffer space into the target room and after the oxygen concentration in the spatial atmosphere of the target room drops below the predefined value to prevent or control a fire in the target room and the mechanism is deactivated, the oxygen concentration in the spatial atmosphere of the buffer space does not rise by more than 0.15% by volume as the room air is introduced from the buffer space into the target room and until the mechanism is deactivated.

2. The system according to claim 1, wherein the mechanism comprises a fan or blower fluidly connected or connectable to the buffer space on a first side and to the target room on a second side for the introduction of the room air from the buffer space into the target room when needed.

3. The system according to claim 2, wherein the mechanism comprises a device for opening of a vent as needed to introduce the room air from the buffer space into the target room, wherein the vent fluidly connects the buffer space to the target room, and wherein the vent is one of a door, bulkhead, roll-up door, and an air lock.

4. The system according to claim 2, wherein a pressure-compensating device is provided to compensate a pressure differential between the buffer space and the target room resulting from the introduction of the room air from the buffer space into the target room.

5. The system according to claim 2, wherein the predefined value corresponds to a critical oxygen concentration limit for extinguishing fire.

6. The system according to claim 1, wherein the mechanism comprises a device for opening of a vent as needed to introduce the room air from the buffer space into the target room, wherein the vent fluidly connects the buffer space to the target room, and wherein the vent is one of a door, bulkhead, roll-up door, and an air lock, for introducing room air from the buffer space into the target room when needed.

7. The system according to claim 6, wherein a pressure-compensating device is provided to compensate a pressure differential between the buffer space and the target room resulting from the introduction of the room air from the buffer space into the target room.

8. The system according to claim 1, wherein a pressure-compensating device is provided to compensate a pressure differential between the buffer space and the target room resulting from the introduction of room air from the buffer space into the target room.

9. The system according to claim 8, wherein the pressure-compensating device is fluidly connected or connectable both to the buffer space as well as to the target room; and/or wherein the pressure-compensating device is fluidly connected or connectable both to the target room as well as to the external atmosphere; and/or wherein the pressure-compensating device is fluidly connected or connectable both to the buffer space as well as to the external atmosphere.

10. The system according to claim 1, wherein the predefined value corresponds to a critical oxygen concentration limit for extinguishing fire.

* * * * *